United States Patent [19]

Woolpert

[11] 3,933,415

[45] Jan. 20, 1976

[54] PAINTING SYSTEM

[76] Inventor: John C. Woolpert, 1717 Ala Wai Blvd., Honolulu, Hawaii 96815

[22] Filed: May 11, 1973

[21] Appl. No.: 359,340

[52] U.S. Cl. ..... 401/145; 401/197; 401/270; 401/204

[51] Int. Cl.² ..... B05D 1/28

[58] Field of Search ..... 401/145, 188, 197, 204, 401/270; 222/481, 482, 485, 486, 386.5

[56] References Cited

UNITED STATES PATENTS

| | | | |
|---|---|---|---|
| 2,678,557 | 5/1954 | Black | 401/145 X |
| 2,793,379 | 5/1957 | Moore | 401/145 X |
| 2,865,541 | 12/1958 | Hicks | 222/386.5 |
| 3,174,658 | 3/1965 | Wittenberg et al. | 222/386.5 |
| 3,184,113 | 5/1965 | Curtis | 222/386.5 |
| 3,662,929 | 5/1972 | Sims | 222/386.5 |

FOREIGN PATENTS OR APPLICATIONS

| | | | |
|---|---|---|---|
| 214,328 | 2/1957 | Australia | 401/188 |

*Primary Examiner*—Lawrence Charles
*Attorney, Agent, or Firm*—James C. Wray

[57] ABSTRACT

A painting system has a container and a flexible wall with a source of pressure on the flexible wall for extending the flexible wall toward the paint and forcing paint through an opening, a valve and a conducting tube into an applicator. A membrane is fitted inside a container, and a cover is placed over the container. Ordinary water pressure from a tap is fed through the hose into the membrane area forcing the membrane toward the paint, and forcing the paint from the container. In one applicator, paint is fed into a hollow tube which is turnable to align openings in a tube wall with distributors which communicate the paint to a plurality of tubes. Paint flows through the selected tubes through an array of openings in paint distributing surfaces. A relatively narrow, pointed surface extends outward from a relatively large circular surface. An auxiliary distributing surface extends perpendicularly to the pointed surface. A sponge roller is provided with a fitted cover and is positioned over a foraminous tube. Extensions on the tube support semi-circular walls at ends of a semi-cylindrical housing. A flange extends around edges of the housing substantially tangentially to the roller surface. Slots in the semi-circular walls and springs urge the flange toward the surface to be painted. An edging device is provided with a truncated conical sponge roller, end plates on the roller and a slideable guard on the remote end of a tube with a spring urging the guard toward the surface to be painted. In a brush modification, paint is flowed to a header and then to a series of tubes which open near tips of bristles.

14 Claims, 10 Drawing Figures

PAINTING SYSTEM

BACKGROUND OF THE INVENTION

Conventional painting techniques employ brushing, spraying or rolling paint onto a surface to be coated. In brushing operations, brushes of selected sizes are dipped into containers of paint, part of the paint is removed from the brush by touching a brush or drawing a brush along an edge of the container, the paint-laden brush is touched to the surface to be coated in several places, and then the paint is evenly spread over a limited area before repeating steps of the cycle. Because of the wiping and working nature of brush techniques and the accompanying working of the coating into surface irregularities, brushing has been recognized as one of the desirable ways of producing a coating.

Rolling techniques are accomplished by coating a roller with paint in a tray or a pail, removing part of the paint from the roller, such as by compressing the roller surface on a tray or shaking excess paint from the roller, and rolling the roller along the surface to be painted, usually in one direction and then in another direction. While a normal force is exerted between the roller and the surface to be coated, little frictional forces are developed. Consequently, the paint may not be warped into the surface to be coated as much as in brushing techniques. However, long experience with rolling has indicated that rolling is a desirable method of coating surfaces with paint. In some situations, rolling paint may fling small specks of paint in undesired directions. That condition, while tolerable in some situations, creates problems in other situations.

Spraying techniques employ air operated jet pumps to draw paint from containers and to break up the paint into fine-misted droplets. Paint is propelled by the air from a nozzle to a surface to be coated. Because there is no working of the paint once it reaches the surface, spraying must be less desirable for certain purposes than brushing or rolling techniques. Spraying has the added disadvantage of propelling paint droplets in undesired directions and coating surfaces other than the surface intended to be coated.

While the equipment needed for brushing and rolling may not be cumbersome and expensive, paint spraying apparatus usually requires an air compressor, an air storage device, heavy duty air hose and connection, and an expensive spraying gun. Air compressor operated spraying systems are well known.

Some systems have been described which cap a conventional paint can and tightly grip the paint can against the possibilities of explosions and pressure leaks and then deliver air from a compressor into the paint can to force paint out through an elongated tube to a roller for distribution. The clamps may be difficult to apply uniformly to insure against rupture or leakage of the pails, and an expensive air compressor is required to drive the paint.

An additional drawback of spraying devices is the need to initially and continuously adjust the paint viscosity to a correct degree for preventing clogging of the sprayer or running of the coating once it is applied.

SUMMARY OF THE INVENTION

The present invention introduces a new technique for the application of paint. The keynote of the invention is non-stop painting. An internal flow system completely eliminates the time consuming process used by familiar brushes and rollers. The dipping requirement of known applicators that slows the painter down and therefore balloons the cost of painting is eliminated in the present invention. Painting contracts undeniably show how slow the painting process is with 10 to 1 labor to material cost ratios. The practical need for new painting equipment is apparent, and the present invention fulfills this need.

The present painting system embodies the principal of moving paint from a supply tank under pressure, or from an elevated tank in a gravity flow system, through a flexible line to a distributor, which may be a speed brush variable applicator, non-stop roller, corner roller or edger. With an operating pressure of approximately 25 psi, paint flows from the supplier through connecting line to the distributor, then inside the distributor where flow control is adjusted, and finally out through jet openings in the surface for non-stop painting. In the case of the speed brush the paint is fed internally to the extremities of the bristles. Each of the five distributors are interchangeable with the supply system, whether pressure or gravity type and will vary in individual size for various job requirements.

The complete range of equipment comprises five distributors, a speed brush, a variable applicator, a non-stop roller, a corner roller and an edger; a special handle; and two supply systems.

The speed brush has a handle with a hollow interior through which a tube passes from the end of the handle to the base of the brush housing, where there is a thumb controlled valve regulating paint flow. In a preferred embodiment the housing of the brush is circular in form at its base, rather than rectangular as in the typical brush. The circular base provides sufficient housing for the bristles that have a unique outward flare without loss of bristle density at the end of the brush. The outward flare of the bristles enables the painter to move into corners with ease and helps to maintain a dripless brushing action with constantly flowing paint. The interior construction of the brush has a flexible dispersing unit appearing much like a flattened funnel. This unit spreads the paint coming in from the flexible tubing out into the fan shape of the bristles and contains the paint so that it is not free until it reaches to within one-quarter to three-eighths inches of the tips of the bristles. The unique combination of the flare brush and internally supplied paint coupled with the finger-tip control provides the system with non-stop brush painting.

This completely new variable paint applicator enables painting as fast as the painter wishes to move, with finger tip control. The primary function of the variable applicator is to serve as an all-in-one interior painter. This multipurpose applicator using the system techniques speeds and simplifies the painting of everything from painting flat surfaces, to edging, cornering, striping and touching up.

The overall appearance of the variable applicator is that of an eyedrop cut in half. At the upper point of the eyedrop there are two features. First there is a cornering device that permits painting of inside corners. The second feature uses the other side of the cornering device and has an edging surface with protector for edging a surface or for one wall cornering. In the middle of the eyedrop back there is a four-way control valve with a dial and a pointer for the directional control of paint flowing to the jets. The valve setting determines applicator use such as pointing or spotting, inside cornering only, edging or narrow striping, flat surface painting. On the left side of the center section there is an on-off flow control valve which is thumb operated. The bottom of the eyedrop-formed applicator has a ¼ inch male fitting for connection to the flexible line and a flow control valve that regulates the amount of paint flowing into the applicator. The flat surface of the variable applicator has 29 jet openings controlled by three of the different valves described above. This flat surface to which the paint is internally fed is designed as a replaceable unit with interchangeable textured materials for varied job requirements. Two of the three valves controlling the paint flow are standard shut off and needle valves. The third valve is unique in that it is designed with a central vertical core having four openings offset from each other in such a manner as to direct the paint flow, one at a time, into four annular manifolds mounted one on top of the other. Each manifold has its own connecting lines to specific jet openings on the surface of the applicator. Example: position 1 on the dial keeps all jets closed except the one at the point of the eyedrop used for pointing or spotting. Position 2 opens eight jets in all on the left side and bottom of the applicator for painting inside corners only. Position 3 on the dial opens three jets for edging or narrow striping, while keeping all other jets closed. Position 4 on the dial opens all the jets on the flat surface for painting walls, etc.

The non-stop roller uses the internal flow concept and provides the painter with two unique features. Regulated paint flow to the roller surface provides non-stop painting. The elimination of paint splatter is accomplished through the incorporation of a plastic cover or guard that houses the roller and collects all splattered paint as it flies off the spinning roller in action.

As in the case of the speed brush, the non-stop roller is constructed with a hollow handle having a thumb controlled valve regulating paint flow. This handle is in addition to the universal handle with a shut off valve as described below.

The roller unit consists of a cylindrical synthetic sponge, approximately 2 inches in diameter for the 7 inch roller. The tube on which the roller is mounted has jet openings throughout the length of the tube which is covered by the roller. To eliminate wear on the inside of the synthetic roller a closely fitting perforated plastic tube or spring is inserted over the tube, keeping the moving roller from contact with the stationary tubing. To provide a variable textured rolling surface and to eliminate wear of the roller on the outside, replaceable jackets are constructed of light, medium and coarse material sleeves that slip over the roller and that contact the surface of the roller.

In creating the unique feature of splatterless roller painting, a plastic cover with an adjoining flat roller finisher has been designed. The plastic cover has a simple attachment feature allowing for elimination or replacement on roller units at will. The flat roller finisher is adjustable for contact with the painting surface as an aid to smoothing out the paint spread on the surface by the roller. It is designed for quick replacement of interchange with units of light, medium or coarse material, as used on the roller. The flat roller finisher provides a unique feature of spreading the paint into corners and edging unlike conventional rollers.

The corner roller has the same basic construction as the non-stop roller, excepting the lengths and shapes of the rollers. The shape of the corner roller is best described as annular with a sloping outer surface and a pointed outside edge. The typical dimensions on this roller are two inches through the center with a 4 inch maximum diameter. A plastic cover with a roller finisher and variable textured jackets are provided for use in the corner roller, as in the non-stop roller.

The edger is of the same basic construction as the non-stop roller and corner roller. A unique feature of the edger, in addition to its internal controlled flow of paint, is the plastic shield at one side of the roller. This shield, held under spring tension of a rubber band, is projected out ahead of the roller for proper placement. With light hand pressure the roller is brought into position against the painting surface and the plastic shield. The shape of the roller unit is best described as that of a truncated cone with the pointed half removed. The size of the edger varies with job requirements, but compares with the established sizes of the corner rollers, the typical size being two inches through the center with an overall 4 inch diameter. The edger can be used with or without a plastic cover to safeguard against paint splatter.

The non-stop roller, corner roller and edger are all designed to connect with a new universal handle with a shut off valve. The handle hooks up at the end of the quarter-inch flexible line supplying pressurized paint. The base of the hollow handle has a one-quarter inch male fitting, for hose connection, and a flow control shut off valve at the other end with a female fitting to allow attachment of desired distributor.

The pressure supply tank with an approximately three and one-quarter gallon capacity is designed to withstand a pressure of 75 psi. This unit provides the distributors with paint at an operating pressure of approximately 25 psi. Working with a full capacity of three gallons of paint the tank is designed to hook up to a standard garden hose, with a built-in pressure regulator set at 25 psi. The pressure regulator with a hose connector is built into the top of a lid for the pressure tank. The lid with a seal is threaded to attach it at the top of the tank. Fitted to the inside of the lid at the top of the tank is a diaphram capable of expanding to the full size of the tank. The function of the diaphram is to act as a separator between the pressurized water and paint, as the paint is forced out of the tank, through the flexible line and into the distributor. To flush the entire system, including the distributor, requires only the removal of the diaphram and excess paint before turning the water on again. The use of water for flushing and cleaning assumes the use of water base paints. An adapter hose with a funnel type end and a clamp enables hookup to inside showers or kitchen and bathroom water foucets. At the bottom side of the pressure tank an outlet is provided with a shut off valve and a male fitting for the quarter-inch flexible line used to connect paint supply to the distributor. Where overhead space is available, the pressure tank, placed approximately 10 feet above the level of the distributor, delivers paint by gravity force, eliminating the need for a hose and water pressure. To connect the supply with a distributor a 50-foot length of flexible line having a one-quarter inch inside diameter is used.

A portable paint supplier is a plastic container having an approximate capacity of one-half gallon. Hand squeezing the portable supplier forces paint into a distributor when overhead clearance restricts the use of a gravity flow technique. When using the portable paint supplier a hose length of 10 feet is recommended for gravity feeding. A four-foot hose length is recommended when hand squeezing the supplier. In a preferred embodiment, the lightweight portable paint supplier has a flat bottom for free standing. A shut off valve with male fitting for a quarter-inch flexible line hookup is mounted at the base of sidewall. A 3-inch built-in handle is provided for carrying the supplier or belting it through for portage at a waistline. A hook at the top of the handle attaches to overhead fixtures. A screw-on cap with a two-inch opening has a one-way air valve to permit air flow into the container. The top of the container serves as a squeeze portion or bubble for hand pressurizing the container.

One object of the invention is the provision of a paint applying system having a paint container and a flexible wall in engagement with paint in the container, whereby moving the flexible wall in the direction of the paint forces paint from the container to a paint distributor.

Another embodiment of the invention is the provision of a paint applying system with a squeezable flexible wall paint container for forcing paint toward an applier.

Another object of the invention is the provision of a paint applying system having a rigid wall container with a flexible membrane contacting paint within the container and a water pressure system for forcing the membrane toward the paint and driving paint from the container.

Another object of the invention is the provision of a paint applying system having a distributor which has several paint applying surfaces and paint supplying openings leading to the surfaces with a variable communication device for communicating a paint supply with selected openings.

Another object of the invention is the provision of a paint applying system with a splatter shield for rollers and edging around the splatter shield.

Another object of the invention is the provision of a paint applying system with spring-mounted shields adjacent paint distributors for contacting a surface adjacent the distributor.

Another object of the invention is the provision of a paint applying system having roller type distributors with porous rollers and fabric sleeves for covering the rollers.

Another object of the invention is the provision of a paint applying system having a distributor brush with a bladder being flattened into a plurality of radiating fine tubes opening near tips of bristles for supplying paint continuously to the bristle tips.

These and other features, advantages and objects of the invention are apparent in the disclosure which includes the foregoing and ongoing specification, and the claims, and the drawings.

DETAILED DESCRIPTION OF THE DRAWINGS

Figure 1:
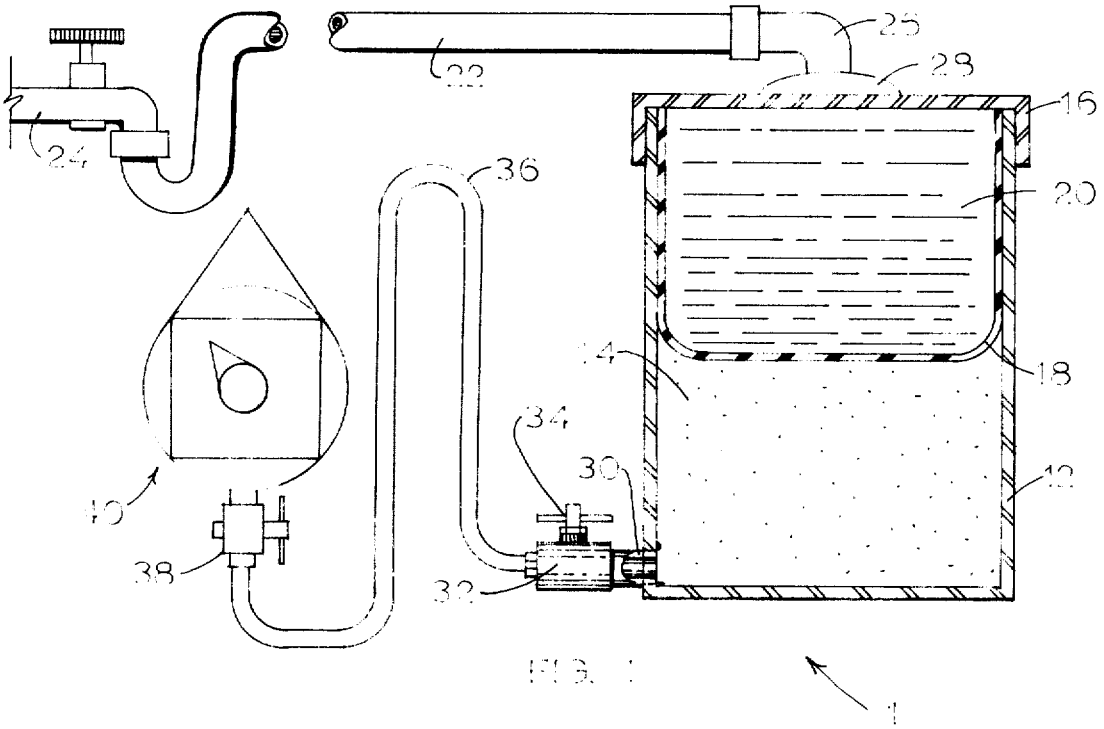
FIG. 1 is a schematic detail of a paint applying system of the present invention using water pressure to move a diaphram in the direction of paint within a rigid container for supplying paint to a distributor.

In FIG. 1, a paint applying system is generally referred to by the numeral 1. A paint holding tank 12 has a supply of paint 14. A lid 16 on top of container 12 seals the container. A flexible rubber diaphram 18 expands downward in the direction of paint 14 when filled with water 20 from a hose 22. As faucet 24 is turned on, water pressure fills holes 22 and fitting 26. A pressure regulating valve 28 limits water pressure to diaphram 18 to about 25 psi. An over pressure water release valve is connected to the lid to release water from diaphram 18 in the improbable event of failure of pressure regulator 28.

Figure 2:
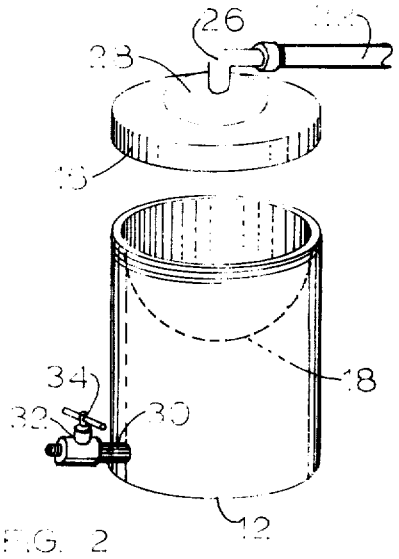
FIG. 2 is a detail of the paint container shown in FIG. 1.

As seen in FIGS. 1 and 2, outlet 30 is connected to a valve 32 which is controlled by handle 34. Paint flows through flexible tubing 36 to valve 38 and then to distributor 40.

Figure 3:
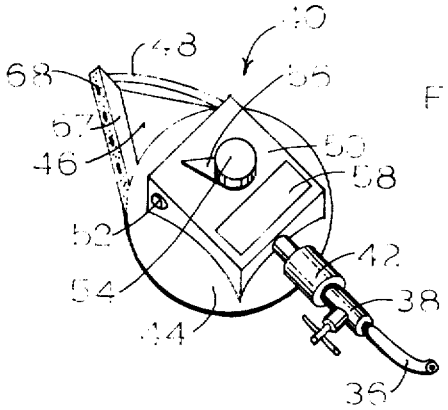
FIG. 3 is a top perspective view of a paint distributor shown in FIG. 1.

In FIG. 3 distributor 40 is shown with a fitting 42 and a substantially semi-cylindrical body 44 which has a pointed projecting end 46. A shield 48 extends perpendicularly along one side of end 46. A variable selector control housing 50 is mounted on top of the body 44. A thumb button 52 controls the flow of paint, permitting flow when the button is depressed. A selector 54 with a pointer 56 is turned to select flow to groups of orifices in the painting surfaces. Plate 58 indicates which selections are best suited for certain painting functions.

Figure 4:
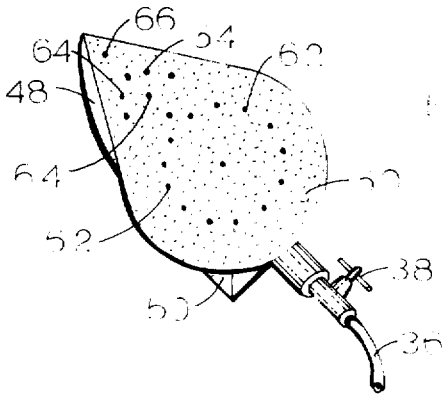
FIG. 4 is a bottom perspective view of the paint distributor shown in FIG. 3.

As shown in FIG. 4 face 60 is a flat surface rounded along one edge and pointed along an opposite edge. A circular array of orifices 62 is open together with an arrow shaped array of orifices 64 and a terminal orifice 66 in the point in one setting of selector 54. That is the desirable setting when spreading paint over a large surface. When smaller surfaces are coated, openings 64 and 66 may be selected to the exclusion of orifices 62 in the circular array. For fine work, opening 66 may be isolated as a single supply orifice. Openings 68 are provided in an outward facing sloping surface of wall 67 which projects upward from the pointed end 46 opposite the thin shield 48.

Figure 5:
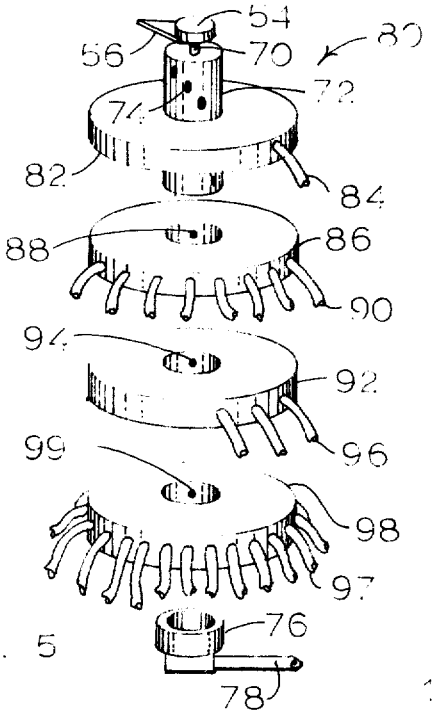
FIG. 5 is a detail of internal selective and variable communication means within the paint distributor shown in FIG. 3.
Figure 6:
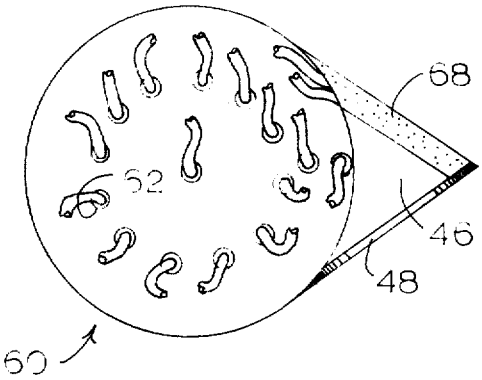
FIG. 6 is an internal detail of the paint distributor shown in FIG. 3.

The means of distribution are best shown with reference to FIG. 5 and FIG. 6. Selector knob 54 and pointer 56 are rigidly connected to stem 70, which is in turn connected rigidly to a hollow cylinder 72 with varied radial openings 74. Tube 72 rotates in sealed relation on bushing 76 which is supplied with paint through pipe 78. Stationary annular communicators 82, 86, 92 and 98 have openings such as indicated at 88, 94 and 99 which communicate with openings 74 at selected positions of the knob 54 to flow paint into predetermined orifices on the spreading surfaces. Tubes 97, for example, lead to orifices 62 as shown in FIG. 6 for full distribution over the lower surface of the roller. The orifices 62 are shown in circular array schematically in FIG. 4. Tubes 84, 90 and 96 lead to other selected openings in the applicator surfaces.

Figure 7:
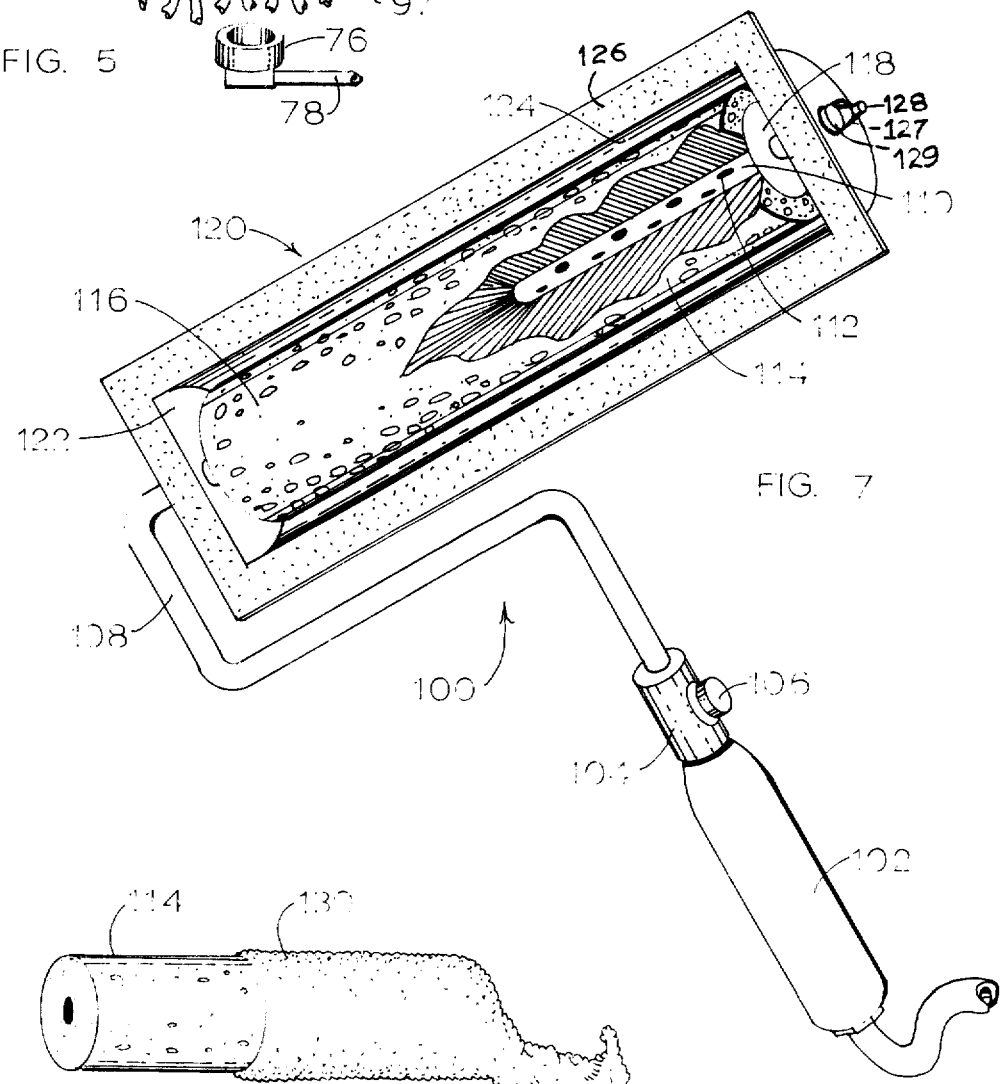
FIG. 7 is a detail of a roller paint distributor with a splatter shield and an edging distributor around the splatter shield.

A shielded roller distributor is generally indicated by the numeral 100 in FIG. 7. A flexible tube leads to handle 102 and to valve 104 which is controlled by thumb button 106. When the button is depressed, paint flows through rigid tube 108 into foraminous tube 110. Paint flows outward through openings 112 into cylindrical sponge 114. The cylindrical surface 116 of sponge 114 coats a wall being painted. Seals 118 prevent radial flow of paint upward from ends of the cylindrical sponge.

A splatter guard and auxiliary spreader 120 has semicircular end walls 122.

Roller 114 is surrounded by a semi-cylindrical wall 124. Flanges 126 are coated with a fibrous material to act as auxiliary spreading areas. As roller 114 is pressed against a wall, flanges 126 are pressed against the wall and smoothe the paint over the wall. The square corners of the flanges enable the complete painting of walls up to corners.

The end walls 122 of the splatter guard are provided with slots. Springs or rubber bands 127 pull lugs 128 which are fixed on the end walls 122 toward roller axle 129, urging the flanges 126 against the wall being painted.

Figure 8:
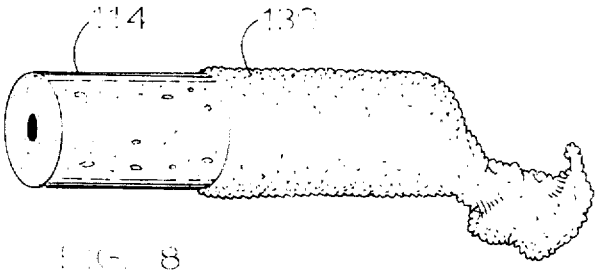
FIG. 8 is a detail of a porous roller being covered by a fabric sleeve.

As shown in FIG. 8, cylindrical sponges 114 are covered with sleeves 130 of fabric, preferably stretchable knitted fabric to provide the desired surface effect and to promote long wear of the roller.

Figure 9:
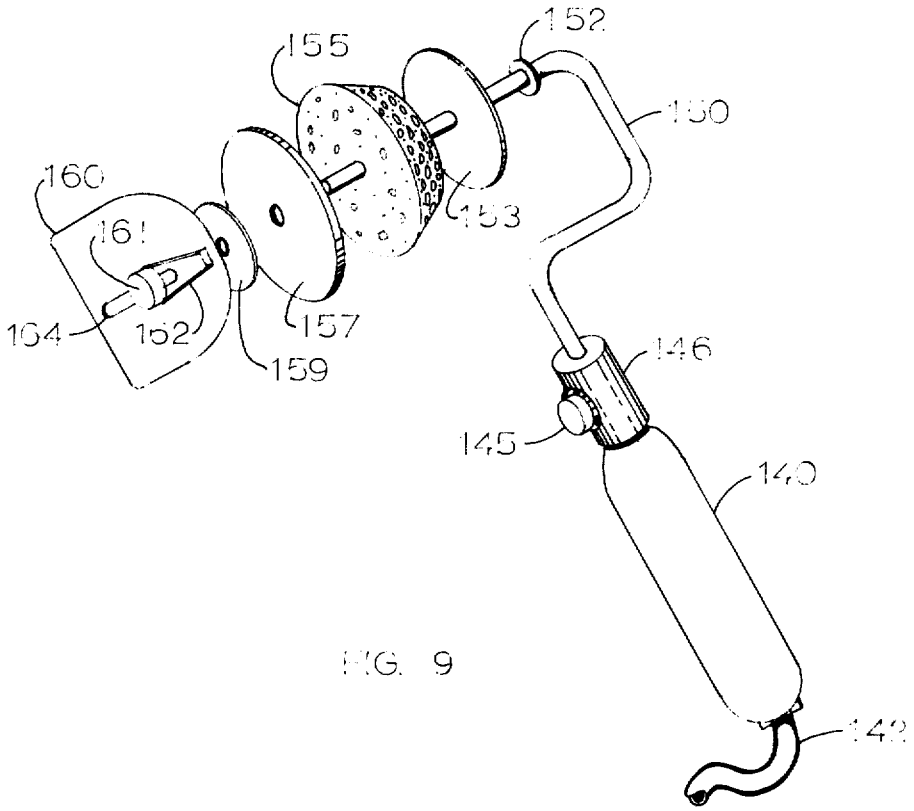
FIG. 9 is a detail of an edger having a edge shield spring mounted adjacent the conical sponge roller.

An edger is generally represented in FIG. 9. Handle 140 is supplied with paint from a pressure source through tube 142. Push button 145 controls valve 146 to supply paint to the rigid bent tube 150. Washer 152 stops sealing plate 153 from moving toward the bend of the handle. Sponge 155, which is preferably a truncated conical sponge, is mounted on a foraminous shaft for receiving paint between plates 153 and 157. Washer 159 permits free movement of the plate.

Shields 160 is mounted on the end of the assembly by attaching tap 161 to the end of the axle. A rubber band 162 is stretched between the cap and a lug to urge shield 160 to the left and downward as shown in the drawing along groove 164. Thus, the straight edge of shield 160 is pressed against the wall in a corner near the large end of sponge 155.

Figure 10:
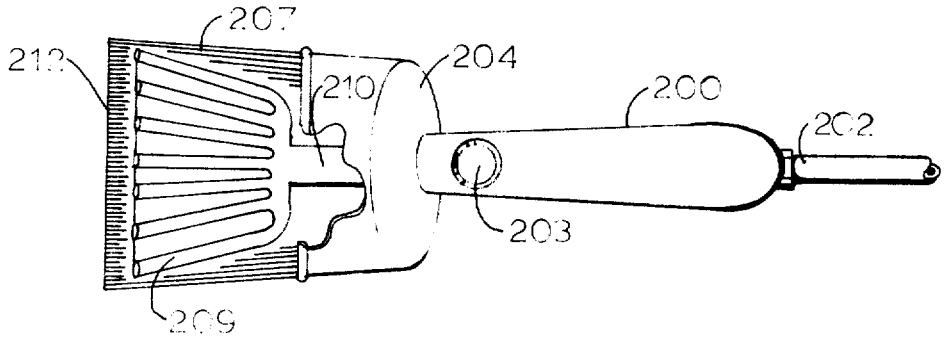
FIG. 10 is a detail of a paint applying system distributor brush of the present invention with an internal bladder and fine tubes terminating near tips of bristles.

In FIG. 10 a speed brush has a handle 200 which is supplied with paint through flexible tube 202. Thumb button 203 controls a valve which supplies paint to the bristles. A circular head 204 holds the anchored ends of bristles 207 in a tapered array. Fine tubes 209 formed by pinching and sealing intermediate portions of parallel webs lead to bladder or header 210 and carry the paint to tips 212 of the bristles for distribution.

Although the invention has been described with reference to specific embodiments, it will be obvious to those skilled in the art that modifications and variations of the invention may be constructed without departing from the spirit and scope of the invention. The scope of the invention is defined in the following claims.

I claim:

1. A paint applying system comprising an upright paint container having a base wall and an upright wall connected to the base wall and extending upward therefrom, paint disposed in the container in contact with the base wall and the upright wall, a flexible wall in engagement with the paint in the container, a water pressure source means for continuously applying water pressure to the flexible wall in a direction to extend the flexible wall toward the paint within the container, an opening in the upright wall near the base wall of the container for flowing paint out of the container through the opening upon pressurizing of the paint by extension of the flexible wall toward the paint, valve means connected adjacent to the opening externally of the container for controlling the flow of paint outward through the opening and through the valve means, and paint conducting means having a proximal end connected to the valve means for conducting paint outward from the valve means, and paint applying means connected to a distal end of the conducting means for receiving and distributing paint flowing to the paint applying means from the conducting means, the paint applying means including a second valve connected to the distal end of the paint conducting means for controlling flow of paint from the paint conducting means to the paint applying means.

2. The paint applying apparatus of claim 1 wherein the container comprises a rigid wall and wherein the source of pressure comprises water superimposed on paint and an elevation of the container above the paint applying means whereby paint flows outward from the container under influence of differential pressures through the conducting means to the paint applying means.

3. The apparatus of claim 1 wherein the container comprises a rigid wall structure having an upward opening and wherein the flexible wall comprises a flexible membrane member connected to the opening for extension toward the paint and further comprising a cover having an opening communicating with the member and a connection means for connecting the opening in the cover to the source of water pressure.

4. The painting apparatus of claim 1 wherein the paint applying means comprises a head having a plurality of distribution tubes and a surface having a plurality of openings connected to the tubes and a selector connected between the conduit means and the tubes for directing flow into selected tubes, and thereby directing flow of paint out through selected openings.

5. The painting apparatus of claim 4 wherein the paint applying surface has a relatively large surface portion near a point of communication with the paint conducting means and has a relatively narrow surface portion remote from the paint conducting means, whereby paint may be directed by the selector to openings in the relatively large portion or to openings in the relatively narrow portion.

6. The painting apparatus of claim 5 wherein the narrow portion terminates in a point remote from the relatively large portion.

7. The painting apparatus of claim 5 further comprising a side wall portion adjacent the surface portion with openings in the side wall portion wherein paint may be flowed selectively through the openings in the side wall portion.

8. The painting apparatus of claim 4 wherein the selector comprises a hollow shaft connected to a dial and means for flowing paint into the hollow shaft, means for mounting the hollow shaft for turning with the dial and stationary means mounted around the shaft and connected to tubes and apertures in a cylindrical wall of the shaft cooperating with complementary apertures in inner walls of the stationary means for aligning therewith and for flowing paint outward from the shaft into the stationary means and thence into tubes connected to the stationary means.

9. The paint applying apparatus of claim 1 wherein the paint applying means comprises a handle connected to the conducting means, a valve connected to the handle remote from the conducting means, a rigid tubular frame extending along an axis of the handle outward therefrom and then at an angle thereto and communicating with a foraminous wall distributor pipe, a cylindrical sponge extending around the pipe, and a cylindrical sleeve fitted over the sponge for flowing paint outward from the foraminous pipe to a surface to be painted.

10. The apparatus of claim 9 further comprising a relatively large semi-cylindrical housing mounted on longitudinal extensions of the foraminous pipe, a flange extending outward from edges of the semi-cylindrical housing, and a soft paint-spreading material mounted on the flange and extending generally tangential to a surface of the fabric on the cylindrical sponge for spreading paint flowing from the sponge and fabric.

11. The paint applying apparatus of claim 10 further comprising elongated openings extending substantially perpendicular to the flange along semi-circular end walls of the semi-cylindrical housing, lug means extending outward from the housing remote from the flange, and spring means connecting the lug means and the pipe extensions for urging the cylindrical housing toward a surface being painted.

12. The apparatus of claim 9 further comprising a generally truncated conical shape on an outer surface of the sponge, end plates at opposite axial ends of the sponge, a plate mounted on a distal foraminous pipe extension, an elongated opening in the plate whereby the plate may slide along the extension, lug means on the plate and spring means connecting the lug means and the pipe extension for urging the plate in a direction toward a wall being painted, whereby the plate acts as an edge shield for preventing flow of paint beyond the plate.

13. The apparatus of claim 1 further comprising a handle on a distal end of the paint conducting means, a valve in the handle, bristle means extending outward from the handle and paint distribution means within the bristle means, the paint distribution means comprising a main paint line from the valve in the handle, a header communicating with the main paint line, and a plurality of distributing tubes extending from the header to positions spaced slightly inward from an outer edge of the bristles.

14. The apparatus of claim 13 wherein the tubes are integrally formed elongated openings in a web which joins the tubes one to another.

* * * * *